US005900210A

United States Patent [19]

Büchler et al.

[11] Patent Number: 5,900,210

[45] Date of Patent: May 4, 1999

[54] HIGH-STRENGTH AND HIGH-DUCTILITY ALUMINUM-BASE ALLOY

[75] Inventors: Erik Büchler, Tomiya-machi; Kazuhiko Kita, Sendai, both of Japan

[73] Assignee: YKK Corporation, Tokyo, Japan

[21] Appl. No.: 08/813,640

[22] Filed: Mar. 7, 1997

[30] Foreign Application Priority Data

Mar. 29, 1996 [JP] Japan ..... 8-076674

[51] Int. Cl.[6] ..... C22C 21/00

[52] U.S. Cl. ..... 420/548; 420/528; 420/529; 420/537; 420/538; 420/550; 420/551; 420/552; 148/559; 148/561; 148/403; 148/437; 148/438

[58] Field of Search ..... 420/528, 529, 420/537, 538, 550, 551, 552; 148/559, 561, 403, 437, 438, 548

[56] References Cited

U.S. PATENT DOCUMENTS

| | | | |
|---|---|---|---|
| 4,729,790 | 3/1988 | Skinner | 75/249 |
| 4,772,370 | 9/1988 | Kreider | 204/192.15 |
| 5,312,494 | 5/1994 | Horimura et al. | 148/437 |
| 5,432,011 | 7/1995 | Du Bois et al. | 428/553 |

FOREIGN PATENT DOCUMENTS

| | | |
|---|---|---|
| 0 675 209 | 4/1995 | European Pat. Off. . |
| 1-275732 | 11/1989 | Japan . |
| 7-238336 | 9/1995 | Japan . |
| 7-268528 | 10/1995 | Japan . |

OTHER PUBLICATIONS

Abstract—Database Chemabs—F. Marino, et al. "Study of New Aluminum–based Alloys Obtained by Rapid Solidification," Chemical Abstracts Service, Columbus, Ohio (1990), and Mater. Eng. (Modena, Italy), 1990.

Abstract—Database Inspec—Bendersky L A, et al., "Microstructural Characterization of Atomized powder of AL–5Mn–5Fe–2Si (wt.%) Alloy," Institute of Electrical Engineers, Stevenage, GB, and Seventh International Conference on Rapidly Quenched Materials, Stockholm, Sweden, Aug. 13–17, 1990, vol. A134, ISSN 0921–5093, Materials Science & Engineering A (Structural Materials: Properties, Microstructure and Processing), Mar. 25, 1991, Switzerland, pp. 1098–1102.

Abstract—Database Inspec—Guo Y X, et al. "Coherence Between Icosahedral Quasicrystals and Aluminum in an Al–Mn–Cr–Si Alloy," and Philosophical Magazine Letters, Apr. 1991, UK, vol. 63, No. 4, ISSN 0950–0839, pp. 179–183.

*Primary Examiner*—Robert Davis
*Assistant Examiner*—M. Alexandra Elve
*Attorney, Agent, or Firm*—Finnegan, Henderson, Farabow, Garrett & Dunner, L.L.P.

[57] ABSTRACT

A high-strength and high-ductility aluminum-base alloy consisting of a composition of general formula: $Al_{ba1}Mn_aSi_b$ or $Al_{ba1}Mn_aSi_bTM_c$ (wherein TM is one or more elements selected from the group consisting of Ti, V, Cr, Fe, Co, Ni, Cu, Y, Zr, La, Ce and Mm; and a, b and c are, in atomic percentages, $2 \leqq a \leqq 8$, $0.5 \leqq b \leqq 6$, $0 < c \leqq 4$, and $a \geqq b$), wherein the alloy contains quasi-crystals. The an aluminum-base alloy have superior mechanical properties such as high hardness, high strength and high ductility.

14 Claims, No Drawings

HIGH-STRENGTH AND HIGH-DUCTILITY ALUMINUM-BASE ALLOY

BACKGROUND OF THE INVENTION

1. Field of the Invention

The present invention relates to an aluminum-base alloy which has superior mechanical properties, such as high hardness, high strength and high ductility.

2. Description of the Prior Art

Conventionally, aluminum-base alloys having high strength and high heat resistance have been manufactured by rapid-solidifying means such as a melt quenching method. For example, the aluminum-base alloy disclosed in Japanese Patent Laid-Open No. 1-275732, which is obtained by the rapid-solidifying means, is an amorphous or microcrystalline alloy, and the disclosed microcrystalline alloy is made from a composite material composed of a metal solid solution made from an aluminum matrix, a microcrystalline aluminum matrix phase and a stable or metastable intermetallic compound phase.

However, the aluminum-base alloy disclosed in Japanese Patent Laid-Open No. 1-275732 is a superior alloy which exhibits high strength, high heat resistance and high corrosion resistance, and also is a high-strength material having superior workability. However, in a high-temperature region, its superior properties specific to the rapidly-solidified material becomes low, and there remains room for improvement in heat resistance, particularly the elevated temperature strength.

In addition, since the alloy disclosed in the above-recited publication contains elements having comparatively high specific gravity, its specific strength does not become so large, and there remains room for improvement in high specific strength as well as ductility.

The alloys disclosed in Japanese Patent Laid-Open Nos. 7-238336 and 7-268528 are known as aluminum alloys containing quasi-crystal in their structures.

Either of these disclosed alloys is superior in mechanical properties and other properties. However, since additive elements, excluding an Al element which is an essential element, and an Mn element, which is a quasi-crystal forming element, have a relatively large specific gravity, there is room to further reduce the weights of the entire alloys.

SUMMARY OF THE INVENTION

The present invention is intended to provide an alloy which has a reduced weight and which is superior in mechanical properties and other properties (particularly ductility) owing to its structure which contains quasi-crystals.

An object of the present invention is, therefore, to provide an aluminum-base alloy which has a structure containing at least quasi-crystals finely dispersed in a matrix of aluminum, and thereby has superior heat resistance, strength and hardness as well as good ductility and high specific strength. To solve the above-described problems, the present invention provides a high-strength and high-ductility aluminum-base alloy consisting of a composition of general formula: $Al_{ba1}Mn_aSi_b$ or $Al_{ba1}Mn_aSi_bTM_c$ (wherein TM is one or more elements selected from the group consisting of Ti, V, Cr, Fe, Co, Ni, Cu, Y, Zr, La, Ce and Mm (misch); and a, b and c are, in atomic percentages, $2 \leqq a \leqq 8$, $0.5 \leqq b \leqq 6$, $0 < c \leqq 4$, and $a \geqq b$), wherein the alloy contains quasi-crystals.

The quasi-crystals have an icosahedral phase (icosahedral, I-phase), a regular decagonal phase (decagonal, D-phase) and/or an approximant crystal phase thereof.

In addition, the structure includes a quasi-crystal phase and a phase consisting of either aluminum or a supersaturated solid solution of aluminum. In some case, such a structure may contain various intermetallic compounds produced by aluminum and at least one of the other elements (i.e., the foregoing Mn, Si and TM) and/or intermetallic compounds produced by two or more of the other elements. The presence of such intermetallic compounds is particularly effective in strengthening the matrix and controlling crystal grains. The volume percent of the quasi-crystals contained in the structure is preferably 20% to 80%.

DETAILED DESCRIPTION OF THE PREFERRED EMBODIMENTS

The aluminum-base alloy according to the present invention can be directly obtained by subjecting a molten alloy having the aforesaid composition to a melt quenching method such as a single-roller melt-spinning method, a twin-roller melt-spinning method, an in-rotating-liquid spinning method, various atomizing methods or a spraying method, or a sputtering method, a mechanical ironing method, a mechanical grinding method or other methods. In any of these methods, the aluminum-base alloy can be manufactured at cooling rates of $10^2$–$10^4$ K/sec, which differ according to the composition of the alloy.

The quasi-crystals in the aluminum-base alloy according to the present invention can be precipitated from a solid solution by subjecting a rapidly-solidified material obtained by any of the above-mentioned manufacturing methods to heat treatment or, for example, by consolidating the rapidly-solidified material and subjecting the consolidated material to hot working such as compacting or extrusion. The temperature in this process is preferably 360–600° C.

The reason why the respective ranges of "a", "b" and "c" in the above-specified general formulae are limited, in atomic percentages, to $2 \leqq a \leqq 8$, $0.5\ 5 \leqq b \leqq 6$, $0 < c \leqq 4$, and $a \geqq b$ is that, in such ranges, the aluminum-base alloy can be imparted ductility as well as a room-temperature strength higher than those of conventional (commercially available) high-strength aluminum alloys after being kept at room temperature and at 300° C.

The grains of the quasi-crystals are composed of three essential elements, Al, Mn and Si. Mn is an element indispensable for forming the quasi-crystals, and if the Mn content is less than the aforesaid range, the quasi-crystals are not formed and the amount of strength becomes insufficient. If the Mn content is greater than the aforesaid range, the quasi-crystal grains become coarse and a ductility of not less than 10% becomes impossible to ensure. Si is a constituent element of the quasi-crystals which contributes to strengthening, and also strengthens a matrix by entering the matrix to form a solid solution. If the Si content is excessive, the quasi-crystals do not form. If the Mn content is less than the Si content, the quasi-crystals do not form, and strengthening becomes insufficient. The TM element is a constituent element of the quasi-crystal, and can also be present as an intermetallic compound phase and is effective in strengthening. If the TM content is greater than the above-specified range, the quasi-crystals are not formed, and coarse intermetallic compounds are formed so that ductility becomes remarkably low. The grain size of the quasi-crystals is desirably not greater than 10 $\mu$m, more desirably not greater than 500 nm.

The volume percent of the quasi-crystals contained in the aforesaid alloy structure is preferably 20–80 vol. %. If the volume percent is less than 20%, the object of the present invention is not able to be satisfactorily achieved, while if it exceeds 80%, embrittlement of the alloy may be incurred, so that the obtained material may satisfactorily not be worked. More preferably, the volume percent of the quasi-crystals contained in the alloy structure is 50–70 vol. %.

In the present invention, the mean grain size of the aluminum phase and the supersaturated solid solution of aluminum is preferably 40–2,000 nm. If the mean grain size is less than 40 nm, the obtained alloy becomes high in strength and hardness, but becomes insufficient in ductility, whereas if it exceeds 2,000 nm, the hardness abruptly lowers, so that a high-strength alloy may not be obtained. The mean grain size of various intermetallic compounds which are present as required is preferably 10–1,000 nm. If the mean grain size is less than 10 nm, the intermetallic compounds do not easily contribute to the strength of the alloy, and if excessive quantities of intermetallic compounds are present in the structure, embrittlement of the alloy may be incurred. If the mean grain size exceeds 1,000 nm, the grains become excessively large in size, so that the strength of the alloy becomes unable to be maintained and the intermetallic compounds may lose the function of a strengthening element.

Therefore, by adopting either of the compositions represented by the above-mentioned general formulas, it is possible to more greatly improve Young's modulas, high-temperature strength, room-temperature strength, fatigue strength and the like.

In accordance with the aluminum-base alloy of the present invention, it is possible to control alloy structures, quasi-crystals, grain sizes of individual phases, the state of dispersion of grains and the like by selecting appropriate manufacturing conditions. According to this control, it is possible to obtain alloys suited to various objects (for example, strength, hardness, ductility or heat resistance).

In addition, it is possible to impart the aluminum-base alloy the nature of a superior superplastic working material by controlling the mean grain size of the aluminum phase and the supersaturated solid solution of aluminum in the range of 40–2,000 nm and by controlling the mean grain size of the quasi-crystals or the intermetallic compounds in the range of 10–1,000 nm.

The present invention will specifically be described below with reference to examples.

EXAMPLE 1

Aluminum-base alloy powders having the respective compositions shown in Table 1 were produced by means of a gas atomizing apparatus. After the produced aluminum-base alloy powders were respectively charged into metal capsules, degasification was performed to produce billets for extrusion. Each of the billets was extruded at a temperature of 360–600° C. by means of an extruding machine. The mechanical properties at room temperature (hardness and strength at room temperature) as well as the ductility (elongation at room temperature) and the Young's modulus of each of the extruded materials (compacted materials) obtained under the aforesaid manufacturing conditions were examined, and the result of this examination is also shown in Table 1.

TABLE 1

| No. | Alloy (at. %) | Strength (MPa) | Elongation (%) | Hardness (Hv) | Young's modulus (GPa) |
|---|---|---|---|---|---|
| 1 | $Al_{bal}Mn_4Si_2$ | 445 | 15.0 | 140 | 82 |
| 2 | $Al_{bal}Mn_5Si_1$ | 451 | 19.0 | 142 | 83 |
| 3 | $Al_{bal}Mn_4Si_2$ | 425 | 21.0 | 134 | 85 |
| 4 | $Al_{bal}Mn_{3.5}Si_2$ | 411 | 25.0 | 130 | 84 |
| 5 | $Al_{bal}Mn_{2.5}Si_{1.5}Ce_1$ | 435 | 29.0 | 137 | 82 |
| 6 | $Al_{bal}Mn_{2.5}Si_{1.5}Ti_1$ | 441 | 21.0 | 139 | 84 |
| 7 | $Al_{bal}Mn_4Si_2Zr_{0.5}$ | 478 | 26.0 | 151 | 85 |
| 8 | $Al_{bal}Mn_5Si_1Mm_1$ | 423 | 28.0 | 133 | 85 |
| 9 | $Al_{bal}Mn_2Si_1Co_1$ | 433 | 5.0 | 137 | 83 |
| 10 | $Al_{bal}Mn_3Si_1Fe_1$ | 461 | 16.0 | 145 | 83 |
| 11 | $Al_{bal}Mn_3Si_1La_{0.5}$ | 456 | 17.0 | 144 | 84 |
| 12 | $Al_{bal}Mn_3Si_1Y_1$ | 475 | 16.0 | 150 | 83 |
| 13 | $Al_{bal}Mn_4Si_1Ni_1$ | 476 | 18.0 | 150 | 83 |
| 14 | $Al_{bal}Mn_5Si_1Cr_1$ | 486 | 11.0 | 153 | 84 |
| 15 | $Al_{bal}Mn_4Si_2V_{0.5}$ | 468 | 13.0 | 144 | 85 |
| 16 | $Al_{bal}Mn_5Si_2Cu_1$ | 489 | 15.0 | 154 | 85 |

As can be seen from the result shown in Table 1, any of the alloys (compacted materials) according to the present invention has properties which are superior in hardness and strength at room temperature, and properties which are superior in ductility (elongation at room temperature) and Young's modulus. In addition, although each of the compacted materials is heated during production, its properties do not suffer large variations due to heating. Accordingly, it can be understood that any of the alloys is superior in heat resistance.

Samples for TEM observation were cut out of the extruded materials obtained under the above-described manufacturing conditions, and the structures of the respective alloys and the grain sizes of their phases were observed. The TEM observation showed that the quasi-crystals of each of the samples had a single icosahedral phase (icosahedral, I-phase) or a multiphase composed of an icosahedral phase and a decagonal phase (decagonal, D-phase). Approximant crystal phases of those phases were present in particular kinds of alloys. The volume percent of the quasi-crystals in each of the structures was 20–80 vol. %.

Any of the alloy structures had a multiphase composed of a quasi-crystal phase and aluminum or a supersaturated solid solution phase of aluminum, and various intermetallic compound phases were present in particular kinds of alloys. The mean grain size of aluminum or the supersaturated solid solution phases of aluminum was 40–2,000 nm, and the mean grain sizes of the quasi-crystal phase and the intermetallic compound phase were 10–1,000 nm. In compositions in each of which intermetallic compounds were precipitated, the intermetallic compounds were dispersed uniformly and finely in the alloy structure.

It is considered that in each of the present examples, control of the alloy structure and control of the grain size of each phase were effected by degasification (including compacting during degasification) and hot working during extrusion.

As described above, the alloy according to the present invention is superior in hardness and strength and also in heat resistance and ductility, and is useful as a high-specific-strength material having high strength and small specific gravity.

In addition, since the alloy according to the present invention has superior heat resistance, even if the alloy undergoes thermal effects during working, the alloy can maintain the superior properties produced by the rapid-solidifying method and the properties produced by heat treatment or hot working.

In particular, in accordance with the present invention, since a quasi-crystal phase having high heat resistance and high hardness is present in a particular amount because of the peculiarity of the crystal structure of the alloy, it is possible to provide an aluminum-base alloy which has reduced weight and which is superior in mechanical properties and other properties (particularly ductility).

What is claimed is:

1. A high-strength and high-ductility aluminum-base alloy consisting of a composition represented by the general formula: $Al_{ba1}Mn_aSi_b$ wherein a and b are, in atomic percentages, $2 \leqq a \leqq 5$, $0.5 \leqq b \leqq 5$, and $a \geqq b$, wherein said alloy contains quasi-crystals in its structure.

2. A high-strength and high-ductility aluminum-base alloy consisting of a composition represented by the general formula: $Al_{ba1}Mn_aSi_bTM_c$ wherein TM is one or more elements selected from the group consisting of Ti, V, Cr, Fe, Co, Ni, Cu, Y, Zr, La, Ce and Mm; and a, b and c are, in atomic percentages, $2 \leqq a \leqq 5$, $0.5 \leqq b \leqq 5$, $0 < c \leqq 4$, and $a \geqq b$, wherein said alloy contains quasi-crystals in its structure.

3. A high-strength and high-ductility aluminum-base alloy according to claim 1, wherein said quasi-crystals have an icosahedral phase, a regular decagonal phase and/or an approximant crystal phase thereof.

4. A high-strength and high-ductility aluminum-base alloy according to claim 2, wherein said quasi-crystals have an icosahedral phase, a regular decagonal phase and/or an approximant crystal phase thereof.

5. A high-strength and high-ductility aluminum-base alloy according to claim 1, wherein the volume percent of said quasi-crystals contained in said structure is 20 vol. % to 80 vol. %.

6. A high-strength and high-ductility aluminum-base alloy according to claim 2, wherein the volume percent of said quasi-crystals contained in said structure is 20 vol. % to 30 vol. %.

7. A high-strength and high-ductility aluminum-base alloy according to claim 1, wherein said structure includes a quasi-crystal phase and aluminum or a quasi-crystal phase and a supersaturated solid solution of aluminum.

8. A high-strength and high-ductility aluminum-base alloy according to claim 2, wherein said structure includes a quasi-crystal phase and aluminum or a quasi-crystal phase and a supersaturated solid solution of aluminum.

9. A high-strength and high-ductility aluminum-base alloy according to claim 1, wherein said alloy further contains various intermetallic compounds produced by aluminum and the other elements and/or various intermetallic compounds produced by the other elements.

10. A high-strength and high-ductility aluminum-base alloy according to claim 2, wherein said alloy further contains various intermetallic compounds produced by aluminum and the other elements and/or various intermetallic compounds produced by the other elements.

11. A high-strength and high-ductility aluminum-base alloy according to claim 1, wherein said alloy has an elongation of not less than 10%.

12. A high-strength and high-ductility aluminum-base alloy according to claim 2, wherein said alloy has an elongation of not less than 10%.

13. A high-strength and high-ductility aluminum-base alloy according to claim 1, wherein said alloy is any one of a rapidly-solidified material, a heat-treated material obtained by subjecting said rapidly-solidified material to heat treatment and a consolidated and compacted material obtained by consolidating and compacting said rapidly-solidified material.

14. A high-strength and high-ductility aluminum-base alloy according to claim 2, wherein said alloy is any one of a rapidly-solidified material, a heat-treated material obtained by subjecting said rapidly-solidified material to heat treatment and a consolidated and compacted material obtained by consolidating and compacting said rapidly-solidified material.

* * * * *

UNITED STATES PATENT AND TRADEMARK OFFICE

CERTIFICATE OF CORRECTION

PATENT NO. : 5,900,210

DATED : May 04, 1999

INVENTOR(S) : Erik BÜCHLER et al.

It is certified that error appears in the above-indentified patent and that said Letters Patent is hereby corrected as shown below:

Title Page, Item [75], in the Inventors, line 1, " Tomiya-machi" should read -- Kurokawa--.

Title Page, Item [57], in the Abstract, line 7, after "The", delete "an"; and line 8, "have" should read --has--.

Claim 6, Column 5, line 37, "30" should read --80--.

Signed and Sealed this

Twenty-eighth Day of March, 2000

*Attest:*

*Attesting Officer*

Q. TODD DICKINSON

*Commissioner of Patents and Trademarks*